United States Patent [19]

Jalovec et al.

[11] Patent Number: 4,568,005

[45] Date of Patent: Feb. 4, 1986

[54] SNAP-ON CLOSURE FOR BOTTLES

[75] Inventors: Charles M. Jalovec, Manalapan; Denise L. Wynne, Princeton, both of N.J.; Roy Watson, Mount Kisco; Edward A. Kozloski, Babylon, both of N.Y.

[73] Assignee: General Foods Corporation, White Plains, N.Y.

[21] Appl. No.: 566,624

[22] Filed: Dec. 29, 1983

[51] Int. Cl.[4] ..... B65D 25/42

[52] U.S. Cl. ..... 222/472; 222/517; 222/541; 222/556; 222/570; 215/319; 215/DIG. 1; 222/512

[58] Field of Search ..... 222/472, 517, 569, 570, 222/473, 556, 153, 541, 512; 215/319, DIG. 1

[56] References Cited

U.S. PATENT DOCUMENTS

| | | | |
|---|---|---|---|
| D. 196,458 | 10/1963 | Underwood | D58/26 |
| D. 208,567 | 9/1967 | Mitchell | D44/21 |
| D. 244,356 | 5/1977 | Pardo | D9/254 |
| 1,558,709 | 10/1925 | Nenstiehl . | |
| 1,987,055 | 1/1935 | Dival | 221/23 |
| 2,006,963 | 5/1933 | Rollason | 221/11 |
| 2,136,123 | 11/1938 | Baron | 65/31 |
| 2,333,952 | 11/1943 | Pollifrone | 221/23 |
| 2,914,832 | 12/1959 | Lee | 215/319 X |
| 3,090,531 | 5/1963 | Weaver et al. | 222/569 X |
| 3,117,703 | 1/1964 | Henchert | 222/546 |
| 3,168,226 | 2/1965 | Underwood et al. | 222/472 |
| 3,212,686 | 10/1965 | Di Pierro et al. | 222/472 |
| 3,239,112 | 3/1966 | Porcelli | 222/541 |
| 3,282,477 | 11/1966 | Henchert | 222/541 |
| 3,404,816 | 10/1968 | Weber | 222/545 |
| 3,434,620 | 3/1969 | Laurizio | 220/27 |
| 3,458,080 | 7/1969 | Laurizio | 220/27 |
| 3,512,686 | 5/1970 | Penniman | 222/472 |
| 3,567,061 | 3/1971 | Song | 220/27 |
| 3,744,675 | 7/1973 | Song | 222/153 |
| 3,853,250 | 12/1974 | Alpern | 222/517 |
| 4,022,357 | 5/1977 | Dwinell | 222/537 |
| 4,387,819 | 6/1983 | Corsette | 222/569 X |

*Primary Examiner*—Joseph J. Rolla
*Assistant Examiner*—Frederick R. Handren
*Attorney, Agent, or Firm*—Sam D. Walker; Thomas R. Savoie; Daniel J. Donovan

[57] ABSTRACT

Plastic dispensing closures adapted for use on bottles containing products such as syrup and the like and which have an integral handle include a snap-on base adapted to be securely attached to the neck of the bottle and shaped to form a pouring spout, and a pivotal lidi based into engagement with the base, the lid having a thumb-engagable extension positioned adjacent to the handle to facilitate opening and closing of the lid. The closures include a non-releasable tear-away inner seal connected to a pull ring, and are attached to the bottle such that they cannot be removed without being permanently deformed, thereby affording a tamper-evident closure. The closures are capable of accommodating a rather large dimensional bottle tolerance, thereby enabling them to be employed on plastic as well as glass bottles. The closures may be formed as either one-piece or two-piece structures.

22 Claims, 9 Drawing Figures

SNAP-ON CLOSURE FOR BOTTLES

BACKGROUND OF THE INVENTION

The present invention relates generally to closures, and more particularly to closures for use on containers, such as bottles, for liquid food products and the like.

There is a need, particularly in the food products industry, for closures that are capable of securely sealing containers for shipping and distribution purposes, yet allow the container to be easily opened and reclosed by the ultimate user, and which facilitate dispensing of the contents of the container on which they are used. Recently, it has also become necessary for closures employed on food product or drug containers to be made tamper-proof or at least tamper-evident.

For many years, threaded type screw-on closures have been employed on liquid containers, and, more recently, snap-on type plastic closures have become prominent for such containers. Generally, snap-on type plastic closures have been successfully utilized on rigid containers made from glass and metal materials but not as successfully on plastic containers. Although closures of these types are rather inexpensive and are convenient for opening and reclosing containers, they are not easily made tamper-proof or tamper-evident. Moreover, the corresponding opening on the container on which such closures are used, as well as the opening of the closure itself, is not always very convenient for dispensing the contents of the container. Syrup products, for example, are well known for their tendency to drip and run onto the outer surface of their container and to cake around the container opening making reclosure of the container difficult. Accordingly, it is common for syrup to be transferred from the container in which it was purchased to a pitcher having a closure with a pour spout, a handle, and a thumb-operated lid. Although such dispensing pitchers are convenient to use, they have the disadvantage of requiring a separate container.

It is desirable to provide closures for containers for liquids such as syrup and the like that avoid these and other disadvantages of known closures, and it is to this end that the present invention is directed.

SUMMARY OF THE INVENTION

The invention provides closures for use on containers such as bottles and the like that are inexpensive, capable of securely sealing the container on which they are used, and, upon opening of the container by the ultimate user, serve as a convenient dispensing closure that may be easily and repeatedly opened and closed to enable dispensing of the contents of the container as required. The closures may be used on inexpensive plastic containers, and are formed such that any prior opening or other tampering with the closure will be apparent to the purchaser, thereby providing some assurance to the purchaser that the contents of the container on which the closure is used have not been altered.

In accordance with one aspect, the invention provides a closure for a bottle having a neck and an integral handle, the closure comprising a base adapted to snap onto the neck and to securely grip the neck so as to prevent subsequent removal of the base without permanent deformation thereof, and a lid pivotally supported on the base at a peripheral region by means for biasing the lid into engagement with a rim that defines a base opening. The lid is formed with an extension that projects beyond the peripheral region and that is positioned with respect to the handle so as to enable the extension to be depressed by a user holding the handle to pivot the lid to an open position to uncover the base opening.

In another aspect, the invention affords a closure comprising a base and a lid pivotally support on the base. The base includes a substantially tubular portion adapted to receive the neck of a bottle, the inner surface of the tubular portion having a plurality of axially extending resilient ribs adapted to engage the neck and radially inwardly directed ledge means adapted to engage the neck beneath shoulder means on the periphery of the neck. The ribs and the ledge means are cooperable with the shoulder means for securely holding the base on the neck.

The invention also provides a closure comprising a base having a peripheral rim defining a base opening and having a tubular portion adapted to receive the neck to attach the base thereto, a lid pivotally supported on the base, and means for biasing the lid into engagement with the rim to close the base opening. The base opening is curved on a plane transverse to the neck opening and has a first radius of curvature, and the lid is similarly curved and has a second radius of curvature that is slightly smaller than the first radius of curvature such that upon being biased into engagement with the rim the lid uniformly engages the rim to ensure closure of the base opening.

In still another aspect, the invention affords a closure comprising a base adapted to receive the neck of a bottle to which the closure is attached. The base has a rim defining a base opening, and a lid is pivotally supported on the base for engagement with the rim to close the base opening. The base and the lid are formed as a contiguous one-piece structure of resilient material and are connected together at an extension of the lid that projects beyond the rim and a corresponding projecting base extension that is formed to bias the lid into contact with the rim so as to close the base opening.

DESCRIPTION OF THE PREFERRED EMBODIMENTS

The invention is particularly well adapted for use as a closure on bottles containing syrup and the like, and will be described in that environment. However, as will be appreciated from the description which follows, this is illustrative of only one utility of the invention, and the invention has more general applicability as a closure for other types of containers and for different products.

Figure 1:
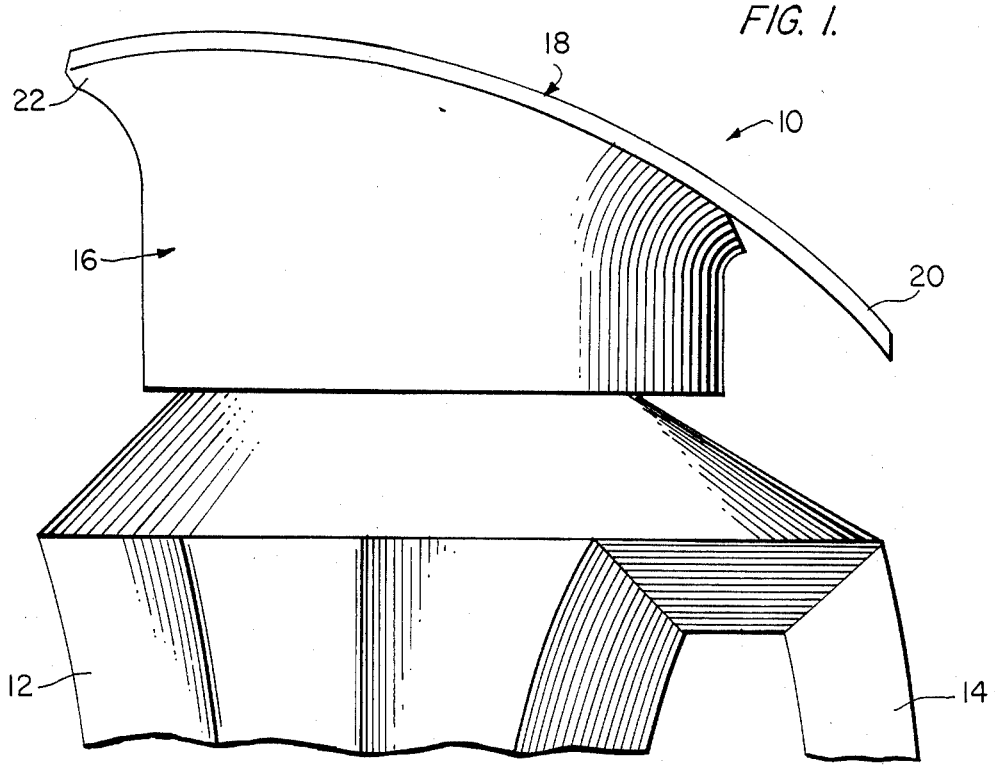
FIG. 1 is a side elevational view of a first embodiment of a closure in accordance with the invention, the closure being shown applied to a bottle.
Figure 2:
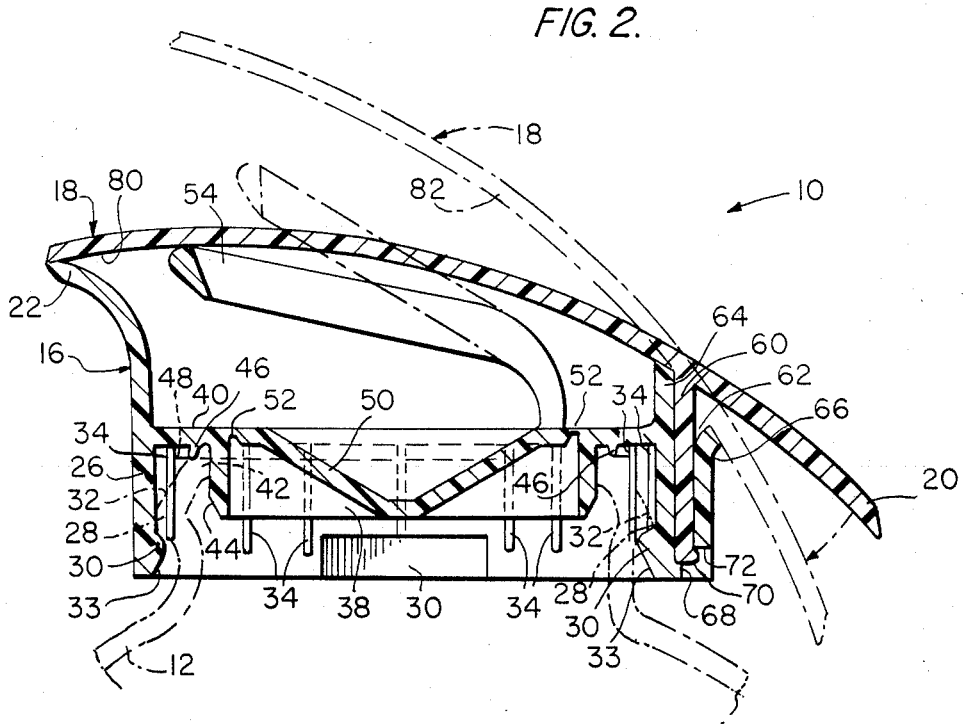
FIG. 2 is a cross sectional view of the closure of FIG. 1 taken approximately along the lines 2—2 of FIGS. 3 and 4.

FIG. 1 is a side elevational view of a first embodiment of a closure 10 in accordance with the invention, the closure being shown applied to a container or bottle 12, as for containing syrup, formed with an integral handle 14 to facilitate grasping of the bottle for pouring syrup therefrom. Bottle 12 may be of glass or, more advantageously, preferably of plastic such as polypropylene. As best illustrated in FIG. 2, and as will be described in more detail shortly, closure 10 is a two-piece snap on structure comprising a base 16 and a lid 18 pivotally supported on the base for movement between a closed position (the solid line position in FIG. 2) and an open position (the phantom line position illustrated in the figure). In the closed position, the lid covers the opening provided in the top of the base to close the container, and in the open position the lid uncovers the opening to enable dispensing of the contents, e.g., syrup, of the container.

As is shown in FIGS. 1 and 2, lid 18 has an extended portion 20 projecting beyond the periphery of the base at one side thereof (the right side in the figures). The extended portion is adapted to be positioned adjacent to handle 14 to afford easy access to the extension by the thumb of a user holding the bottle by handle 14. The lid, which is normally biased into engagement with the base as will be described hereinafter, may be moved to open position by depressing extended portion 20 (as with the thumb of the user holding the bottle by handle 14) to cause the lid to deflect, i.e., pivot, to open position. As is shown, the side of the base opposite to that at which the lid is pivoted may be shaped to form a pouring spout 22. Thus, upon depressing extended portion 20 and tilting the bottle, a user holding the bottle by handle 14 may conveniently pour syrup from the bottle. Upon the extended portion 20 being released, the lid pivots to reengage the base and to cover the opening. By locating the lid operating extension 20 adjacent to the handle as shown in FIG. 1, the handle and the closure are integrated to facilitate operation of the closure and dispensing of the contents of the bottle.

Closure 10 is preferably formed of injection molded low density plastic materials. Advantageously, since the closure is a two-piece structure (the base and the lid being separate pieces that are connected together as will be described hereinafter), the base and the lid may be formed of different plastic resins, thereby enabling greater control and selection of the characteristics, e.g., flexibility, of each piece. Preferably, the base is formed of polyethylene and the lid is formed of polypropylene. Polyethylene is preferred for the base because it is somewhat more flexible than polypropylene and facilitates the attachment of the base to the neck of the bottle. Polyethylene and polypropylene are preferred materials since they are rather inexpensive and are easily injection molded. However, other resins may, of course, also be used.

Base 16 is preferably formed to snap onto the neck of the bottle. This enables a more secure and less easily removed attachment of the base to the bottle than does a screw-on type of structure, and facilitates orientation of the thumb-operated extension of the lid to the bottle handle. As shown in FIG. 2, the base may have a lower tubular portion 26 formed to receive the tubular neck of bottle 12. As shown, the neck of the bottle may have a radially outwardly directed circumferential bead or shoulder 28, and the inner periphery of the tubular portion of the base may be formed with a plurality of radially inwardly directed ledges 30 adapted to engage the neck beneath shoulder 28. As shown in the bottom view of the base in FIG. 5, four inwardly directed ledges 30 may be spaced symmetrically about the inner periphery of the tubular portion of the base for engaging shoulder 28. If desired, a greater number of ledges may be formed on the inner periphery of the tubular portion, or a single continuous circumferential ledge may be used, as will be described hereinafter in connection with the second embodiment of the invention. Shoulder 28 and ledges 30 may also be formed with cooperating downwardly sloping cam surfaces 32 and 33, respectively, to facilitate attachment of the base to the bottle. Upon the bottle neck being inserted into the tubular portion, cam surfaces 32 and 33 engage and cause the walls of the tubular portion to flex outwardly to enable shoulder 28 to bypass ledges 30. Upon the neck reaching the position illustrated in FIG. 2, the wall of the tubular portion snaps back to its original position, causing the upper surfaces of ledges 30 to engage the lower surface of shoulder 28, as shown.

Figure 5:
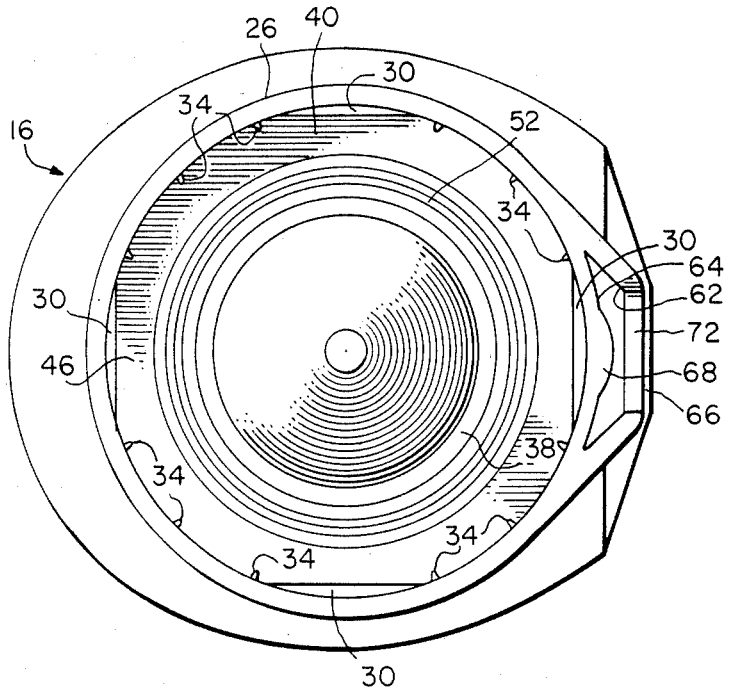
FIG. 5 is a bottom plan view of the base.

The inner surface of tubular portion 26 is also preferably formed with a plurality of elongated axially extending crush ribs 34 spaced about the periphery of the inner surface, as shown in FIGS. 2 and 5. Ribs 34 are adapted to be compressed or crushed by shoulder 28 of the bottle upon insertion of the bottle neck into the base. Because of the resiliency of the material from which the base is formed, the crush ribs exert pressure on shoulder 28 and, in combination with ledges 30, serve to hold the base securely attached to the neck and enhance the seal between the base and the neck of the bottle. The ribs also serve another important function. They compensate for differences in the neck dimensions between different bottles so that the closure may be employed with bottles having larger dimensional tolerances. This is significant in enabling the closure to be employed with plastic bottles, since the industry standard tolerance specification for plastic bottles is much greater than for glass bottles. Thus, if the bottle is large, i.e., near the upper limit of the tolerance range, the ribs will crush more than they would otherwise and enable the closure to fit on the bottle. Similarly, if the bottle is small, i.e., near the lower end of the tolerance range, the ribs will take up the slack while still affording a tight fit between the closure and the bottle.

As also shown in FIG. 2, base 16 may further include another tubular portion 38 disposed interiorally of tubular portion 26 and depending from a substantially horizontal (in the figure) transverse portion 40 of the base. As shown, tubular portion 38 is sized to fit snuggly into the opening or mouth 42 of the bottle neck, and its lower peripheral edge 44 may be sloped as shown to facilitate insertion into the opening. In addition, an annular rib 46 may depend from transverse portion 40 between tubular portions 26 and 38 for engagement with the top 48 of the bottle. Annular rib 46 is formed to flex somewhat in a manner similar to ribs 34, in order to accomodate dimensional variations between the top of the bottle and the lower surface of shoulder 28 and to ensure a tight engagement between shoulder 28 and ledges 30. Tubular portion 38 and annular rib 46 further enhance the seal between the bottle neck and the base.

Figure 6:
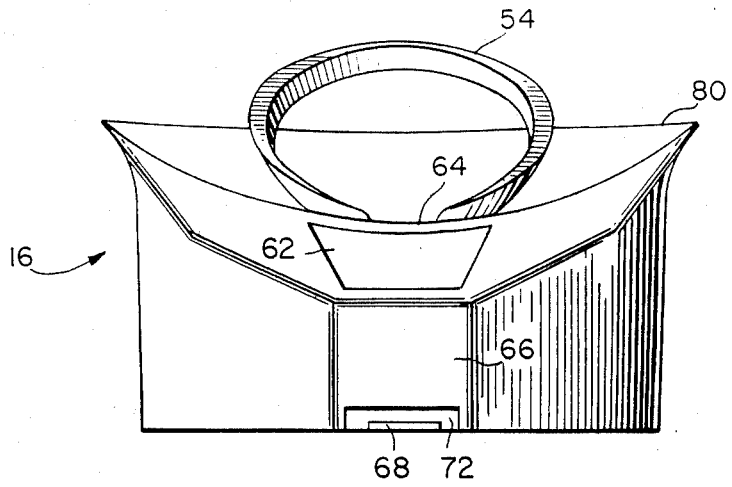
FIG. 6 is an end elevational view of the base.

Interior tubular portion 38 of the base provides an opening to the interior of the bottle that, until the bottle is ready to be used, is sealed by a tear-away diaphram seal 50. As is shown in FIG. 2, seal 50 is preferably a substantially conically shaped member formed integrally with the base and connected to transverse portion 40 by a thin rupturable circular (in the plane of transverse portion 40 as shown in FIG. 5) strip of material 52. The circular strip of material constitutes a tear line for the seal. A finger-engageable pull ring 54 (see FIGS. 4 and 6 also) is integrally formed with the seal and connected thereto at a point adjacent to tear line 52 and near the opposite side of the base from pouring spout 22. Seal 50 seals the bottle until the contents are ready to be used. As is indicated in FIG. 2, pull ring 54 is formed so that it is biased into engagement with the underside of lid 18 when the lid is in its closed position. Upon extension 20 of the lid being depressed and the lid being deflected to its open position, pull ring 54 moves to the phantom line position illustrated in the figure, where it is easily grasped by a user. Upon pulling the pull ring to the left in the figure, tear line 52 ruptures so that the seal can be torn away from transverse portion 40 of the base and removed from the closure, thereby opening the bottle to enable access to its contents. Thereafter, lid 20 serves to open and close the bottle.

As is further shown in FIG. 2, lid 18 may be pivotally attached to base 16 by means of a post or tab 60 depending from the underside of the lid that is received in a cutout or slot 62 formed between walls 64 and 66 at the periphery of the base (see also FIGS. 3–6). When in place, the lower end of post 60 may rest on a ledge 68 at the lower end of wall 64, and the post may be formed at its lower end with a plurality of knobs or projections 70 that are received in an opening 72 at the lower end of wall 66. As is shown in FIG. 2, the dimensions of post 60 and slot 62 are such that the post is closely confined within the slot with knobs 70 engaging the lower surface of wall 66 and the lower end of the post resting on ledge 68. The width of post 60 (in the plane of FIG. 2) is preferably selected with respect to the characteristics of the plastic material from which the lid is formed so as to enable the lid to resiliently deflect to the phantom line position of FIG. 2 upon extension 20 being depressed. As is shown in the figure, the upper end of wall 66 of the base may be bowed outwardly to enable the lid to deflect to the phantom line position. The bowed upper end of the wall also serves as a cam surface that cooperates with knobs 70 to resiliently deflect wall 66 outwardly upon insertion of the post into slot 62 in order to facilitate assembly of the lid and the base.

Figure 3:
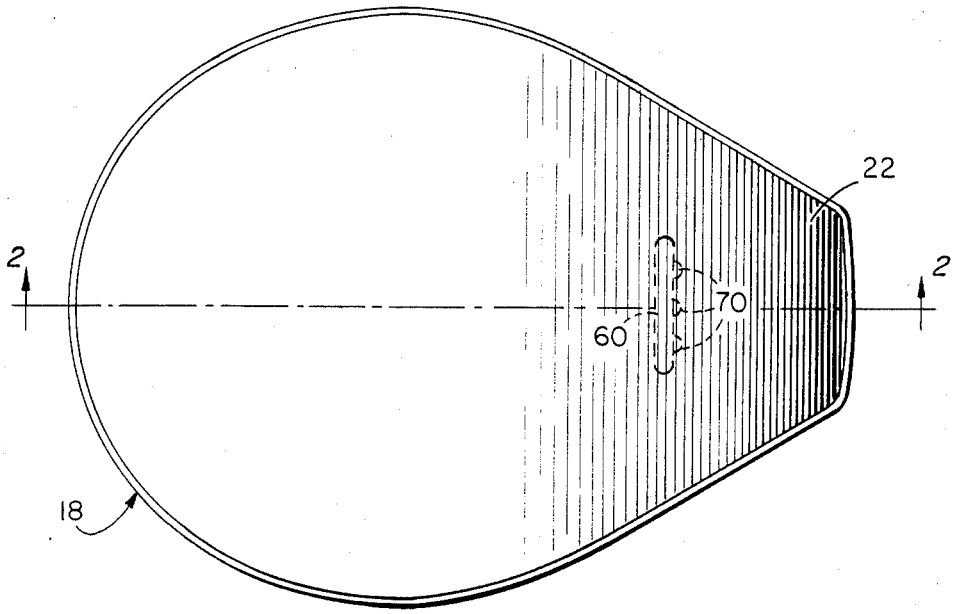
FIG. 3 is a top plan view of the lid of the closure of FIG. 1.
Figure 4:
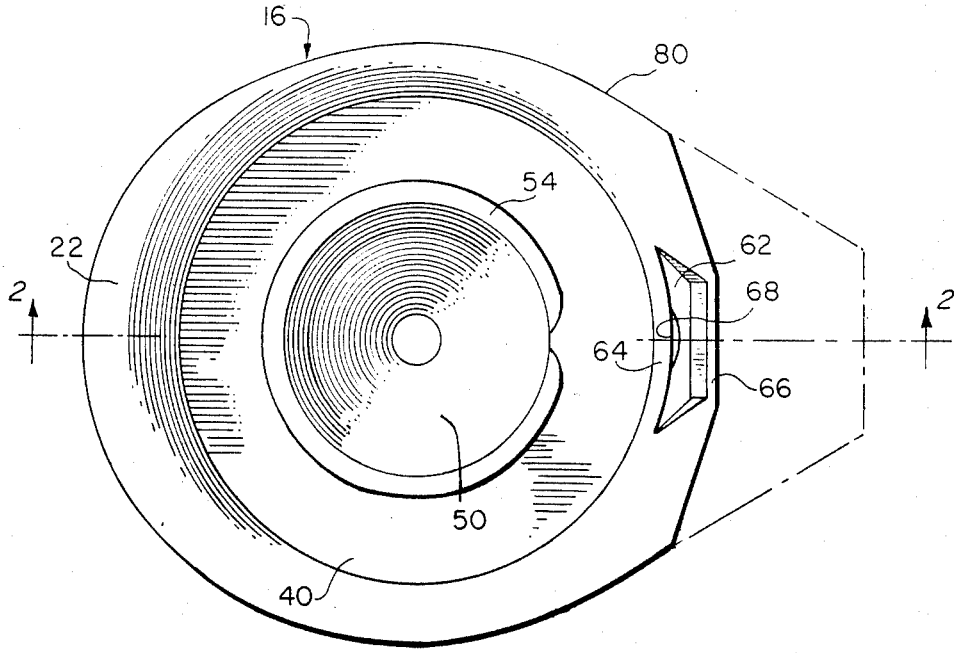
FIG. 4 is a top plan view of the base of the closure of FIG. 1.

As is shown in FIGS 3–5, the upper rim 80 of the base 16 defines a generally circular opening to the interior of the base and affords a rather wide pouring spout 22. The lid 18 has a similar shape, except for extension 20 which projects beyond the rim and the periphery of the base adjacent to slot 62. The rim of the base is curved with an upwardly convex profile and sloped downwardly from spout 22 towards wall 64, as shown in FIG. 2. The curved profile of the rim may be regarded as extending about a horizontal axis located below the rim. Preferably, the curvature of lid 18 (represented by the dotted line 82) is selected such that the radius of curvature of the inner surface of the lid is slightly smaller than the radius of curvature of the rim so that when the lid is in closed position in egagement with the rim, the bias afforded by post 60 causes the lid to deflect slightly and to assume the same contour as the rim. This ensures uniform contact between the rim and the under surface of the lid and a good seal between the lid and the base. As noted earlier, by forming the lid and the base as separate pieces, different plastic resins may be used enabling optimization of the stiffness characteristics, for example, of the base and the lid.

Figure 7:
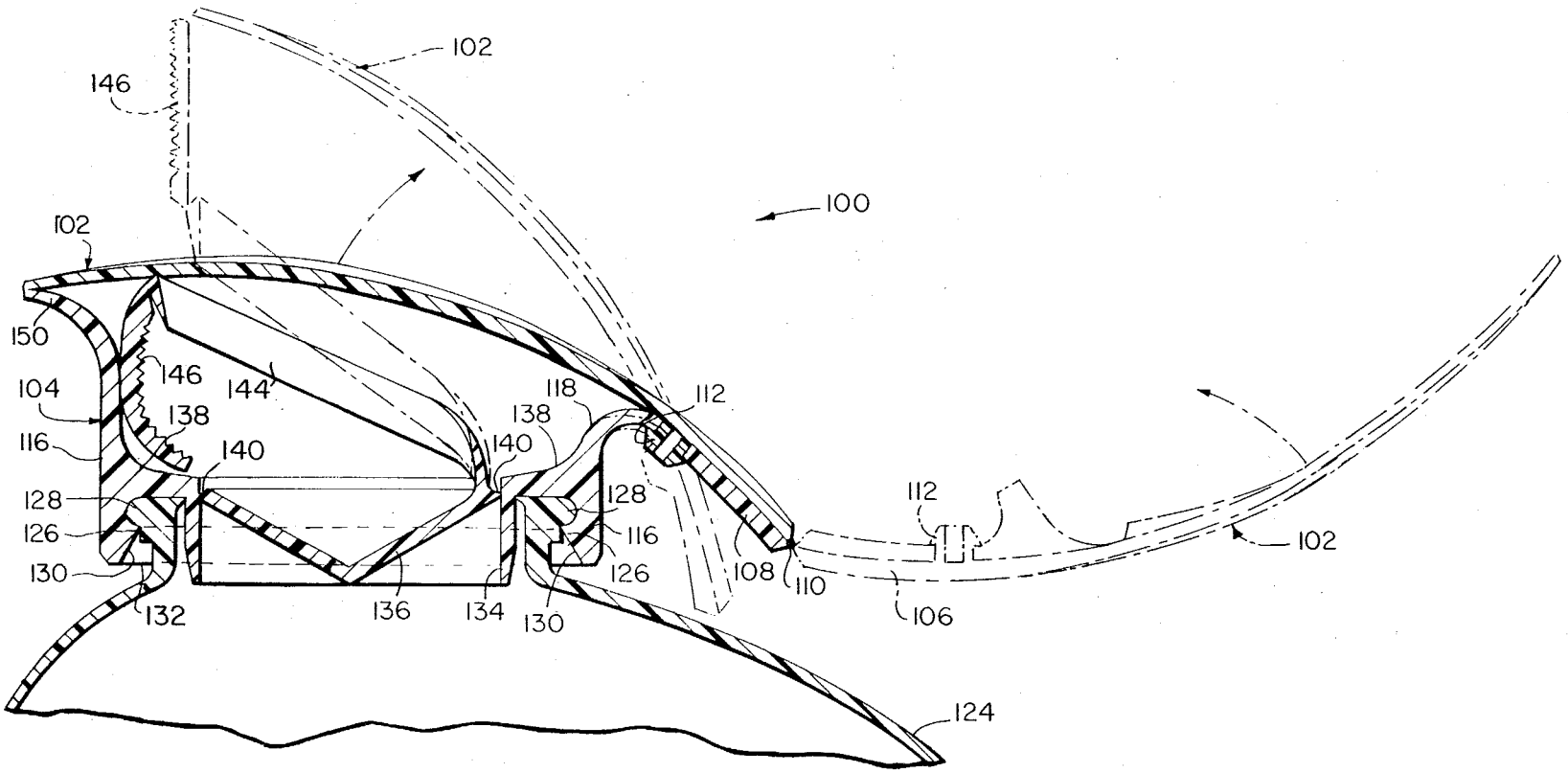
FIG. 7 is a cross sectional view of a second embodiment of a closure in accordance with the invention.
Figure 8:
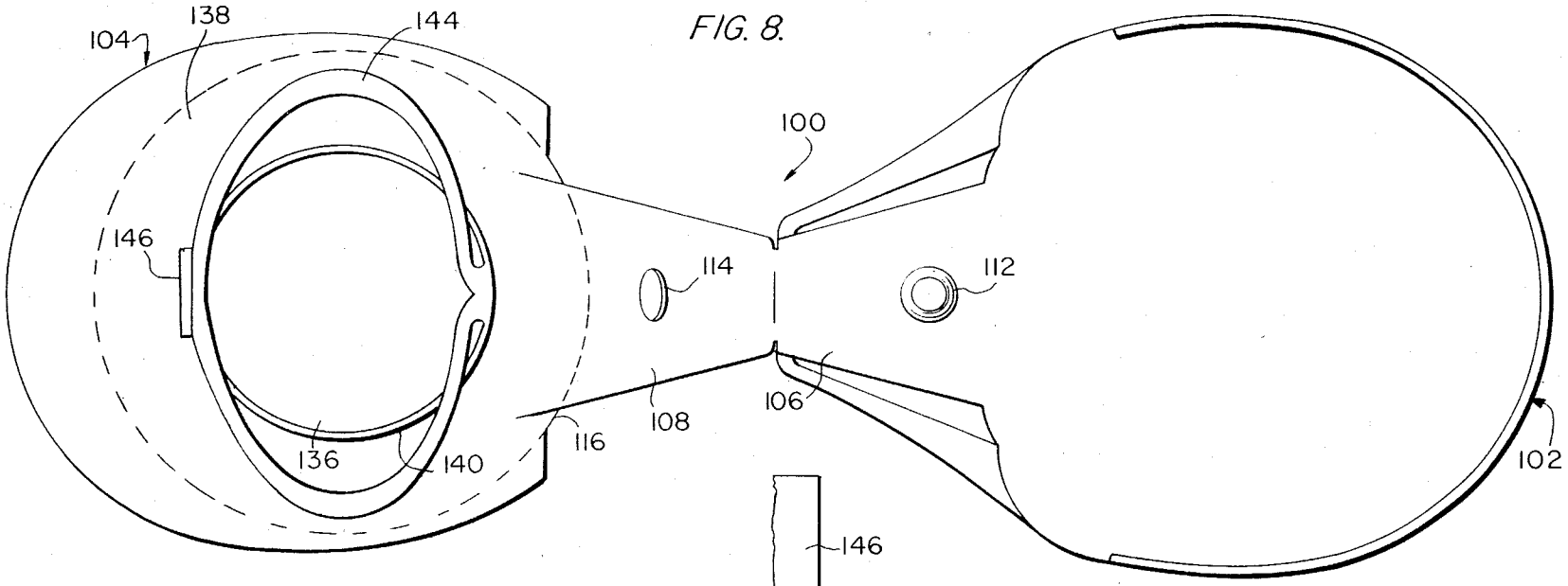
FIG. 8 is a top plan view of the closure of FIG. 7.
Figure 9:
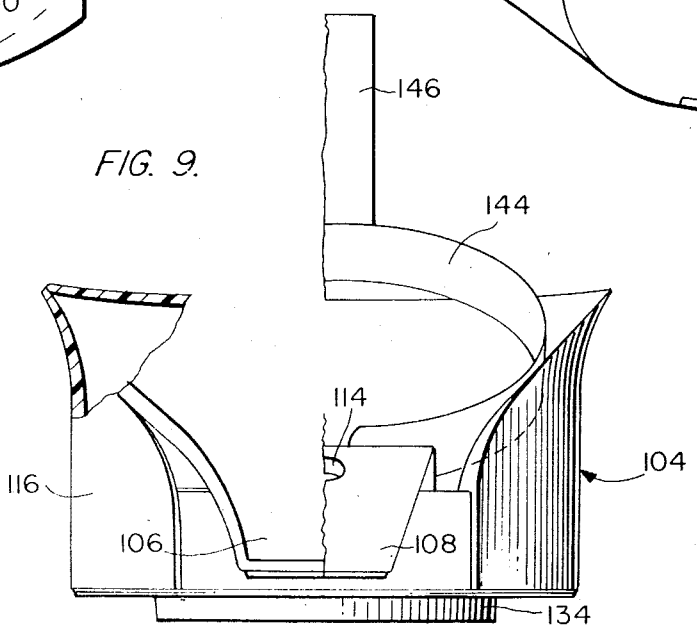
FIG. 9 is a split end elevational view, partially broken away, of the closure of FIG. 7.

FIGS. 7–9 illustrate a second embodiment 100 of a closure in accordance with the invention that is in many respects similar to the first embodiment. One principal difference between the two embodiments is that closure 100 is a one-piece structure and, accordingly, is less expensive since it requires only one mold and minimizes the effort required to assemble a separate base and lid that is typical of many two-piece closures. Closure 100 may be injection molded polyethylene, and, as shown in FIG. 7, lid 102 and base 104 may be connected together at respective lid and base extensions 106 and 108 by a thin connecting strip of plastic material. Lid 102, which may have a shape as illustrated in phantom lines in the figure, may be formed with a locking projection or boss 112 on the underside of lid extension 106, and base extension 108 may have a hole 114 (see FIG. 8) for receiving the locking projection upon the lid being folded back onto the base, in the manner illustrated in FIG. 7, to connect the base and lid together. Base extension 108 may be connected to the tubular portion 116 of the base by a curved member 118 as shown. The curved member serves as a resilient spring member that biases the lid into engagement with the base rim and that flexes upon lid extension 106 (and base extension 108) being depressed to enable the lid to move to open position, as is illustrated in phantom lines. Upon the lid extension being released, spring member 118 returns the lid to closed position (the solid line position). As with the first embodiment, the radius of curvature of the lid may be selected to be slightly smaller than the radius of curvature of the rim of the base so that upon being biased to closed position the lid conforms to the rim to ensure a good seal.

Closure 100 is also illustrated with a somewhat different internal base configuration than closure 10 and applied to a bottle 124 having a somewhat different neck configuration. As shown in FIG. 7, the inner peripheral surface of tubular portion 116 of the base may be formed with a continuous circumferential radially inwardly directed ledge 126 for engaging a peripheral radially outwardly directed circumferential shoulder 128 of the bottle. A downwardly outwardly sloping cam surface 130 may connect ledge 126 with the lower rim 132 of the base, the cam surface cooperating with shoulder 128 in a manner similar to that previously described in connection with closure 10 for attaching the base to the bottle. The base may also include an inner tubular portion 134 adapted to be received in the opening at the mouth of the bottle, and may have a conically shaped tear-away seal 136 connected to an inner transverse portion 138 of the base by a thin circular strip of rupturable material 140 for sealing the opening to the bottle through inner tubular member 134. An integrally formed pull ring 144 may be connected to seal 136 to enable the seal to be torn away by the user, as previously described. The pull ring may have a ribbed extension tab 146, as shown, to facilitate grasping of the pull ring by the user. When the lid is in closed position, the pull ring and tab are folded within the closure in the manner illustrated in the figure. Upon the lid being opened, the pull ring and tab move to the phantom line positions illustrated where they can be grasped by the user to remove the seal. However, a foil seal without a pull ring and extension tab may be utilized. If such a foil seal is employed, an extension of the foil seal may be furnished to provide a pull-away means.

As with the first embodiment, base 104 may be formed with a pouring spout 150, and, in general, the overall shapes of the base and lid of closure 100 may be similar to those of closure 10. Also, instead of the internal configuration of the base illustrated in FIG. 7, the base may have an internal configuration similar to that shown in FIG. 2, having a plurality of ledges rather than a continuous circumferential ledge, and having a plurality of crush ribs to better accommodate dimensional variations between bottles. Conversely, base 16 of closure 10 may be formed to have an internal configuration such as that shown in FIG. 7 for closure 100.

From the foregoing, it may be appreciated that snap-on closures in accordance with the invention offer significant advantages over other known types of closures. Closures in accordance with the invention enable the closure to be tightly and securely attached to the neck of a bottle and are especially advantageous in that they may be used on plastic bottles as well as glass bottles. Once attached to a bottle, the closures afford a very good seal and cannot be easily removed without causing permanent deformation of the closure or the bottle itself. This, in combination with the non-resealable tear-away seal, affords a tamper-evident closure that ensures the integrity of the product to the ultimate consumer. Moreover, by integrating the closure with a handle on the bottle or container on which it is used, the invention affords a particularly convenient and easily used reclosable pouring closure that is especially useful for liquid products such as syrup and the like.

While preferred embodiments of the invention have been shown and described, it will be apparent to those skilled in the art that changes can be made in these embodiments without departing from the principles and spirit of the invention, the scope of which is defined in the appended claims.

We claim:

1. A closure for a bottle having a neck and an integral handle, the closure comprising a base adapted to snap onto the neck, the base including an upwardly facing peripheral rim defining a base opening and means for securely gripping the neck so as to prevent subsequent removal of the base without permanent deformation thereof, and a lid of flexible material pivotally supported on the base at a peripheral region thereof by means for biasing the lid into engagement with the rim so as to close the base opening, the lid being formed with an extension that projects beyond said peripheral region and that is positioned with respect to the handle so as to enable the extension to be depressed by a user holding the handle to pivot the lid to an open position to uncover the base opening, wherein said base opening has a pouring spout at a peripheral region opposite to said first-mentioned peripheral region, and wherein said rim curves from said pouring spout to said first mentioned peripheral region about a horizontal axis located below said rim and has a first radius of curvature, and wherein the lid is similarly curved and has a second radius of curvature that is slightly smaller than the first radius of curvature, such that upon being biased into engagement with the rim the lid flexes and uniformly engages the rim to ensure closure of the base opening.

2. The closure of claim 1, wherein the bottle, the base, and the lid are all formed of plastic materials.

3. The closure of claim 2, wherein the base and lid are separate pieces and are formed of different plastic materials.

4. The closure of claim 1, wherein said gripping means is disposed on the interior surface of a tubular portion of the base that receives the neck, the gripping means comprising radially inwardly directed ledge means for engaging the neck beneath radially outwardly directed shoulder means on the periphery of the neck, and a plurality of axially extending resilient ribs adapted to engage the neck, the ribs and the ledge means being cooperable with the shoulder means for securely holding the base on the neck.

5. The closure of claim 4, wherein the ribs are formed to be crushed by the shoulder means in order to compensate for dimensional variations in the neck.

6. The closure of claim 1, wherein the base further includes an inner tubular portion depending from a traverse member at the interior of the base, the inner tubular portion being adapted to be received in an opening in the neck and to cooperate with said gripping means to prevent said subsequent removal of the base and to provide a seal between the base and the neck.

7. The closure of claim 1, wherein the biasing means comprises a resilient post depending from the underside of the lid, the post being received and confined in a slot in a sidewall of the base at said peripheral region so as to close the lid to be biased into engagement with the rim and being formed to enable the post to flex resiliently upon the extension being depressed to pivot the lid to open position.

8. The closure of claim 1, wherein the base and the lid are integrally formed as a one-piece structure and are connected together at said lid extension and a corresponding base extension located at the underside of the lid extension, the base extension projecting beyond a sidewall of the base at said peripheral region and being connected to said sidewall by a curved resilient portion that biases the lid into engagement with said rim and that resiliently deflects upon the lid extension being depressed to pivot the lid to open position, said biasing means comprising said curved portion.

9. A closure for a bottle having a neck with an opening therein, the closure comprising a base with an upwardly facing peripheral rim defining an opening through the base, and a lid of flexible material pivotally supported on the base adjacent a first peripheral region of the rim and biased toward a position in which it engages the rim to close the opening through the base, the base including a substantially tubular portion adapted to receive the neck, the inner surface of the tubular portion being formed with a plurality of axially extending resilient ribs adapted to engage the neck upon insertion of the neck into the tubular portion, and being formed with radially inwardly directed ledge means adapted to engage the neck beneath shoulder means on the periphery of the neck, the ribs and the ledge means being cooperable with the shoulder means for securely holding the base to the neck, and wherein the base rim is curved between said first peripheral region and an oppositely located second peripheral region about a horizontal axis located below said rim and has a first radius of curvature, and the lid is correspondingly curved and has a second radius of curvature that is slightly less than the first radius of curvature such that upon being biased into engagement with the rim, the lid conforms to the curvature of the rim to engage the rim uniformly.

10. The closure of claim 9, wherein the base is formed of resilient material, and the ledge means and shoulder means are formed with cooperating cam surfaces to enable the base to be snapped onto the neck, the ledge means and the shoulder means being sized such that the closure can be removed from the neck only by permanent deformation of the base.

11. The closure of claim 9, wherein the base further includes another inner tubular portion disposed interiorly of the base from said first-mentioned tubular portion, the inner tubular portion being adapted to fit securely within the neck opening.

12. The closure of claim 11, wherein the inner tubular portion depends from a transverse member within the base, the transverse member including a non-resealable tear-away seal for sealing the neck opening.

13. The closure of claim 12, wherein the base further includes an annular rib depending from the underside of said transverse member for engagement with the top of the neck, the annular rib being operable to bias the ledge means into engagement with the shoulder means.

14. The closure of claim 9, wherein the base is shaped at the second peripheral region to form a pouring spout, and the lid is pivotally supported at the first peripheral region of the base on the opposite side of the base from the pouring spout, the lid having an extension projecting beyond the first peripheral region that is adapted to be depressed to pivot the lid to an open position at which the lid uncovers the base.

15. The closure of claim 14, wherein the lid has a resilient post depending from an underside thereof that is confined within a slot at said first peripheral region, the post being formed to bias the lid into engagement with a rim of the base defining a base opening.

16. The closure of claim 15, wherein the post is formed with knobs at a lower end thereof that are adapted to be received in an opening in a sidewall of the base that is in communication with said slot, the knobs being cooperable with said sidewall opening to confine the post within the slot.

17. The closure of claim 9, wherein the lid and the base are injection molded from different plastic resins selected to afford different stiffness characteristics, and said bottle is also formed of a plastic resin.

18. The closure of claim 9, wherein the lid and the base are formed as a contiguous one-piece structure of resilient material, the lid and the base being connected together at an extension of the lid that projects beyond the periphery of the base and a corresponding projecting base extension connected to the base by a curved portion formed to bias the lid resiliently into contact with the rim of the base.

19. A closure for a bottle having a neck with an opening therein, the closure comprising a base having an upwardly facing peripheral rim defining a base opening and having a tubular portion adapted to receive the neck to attach the base thereto, wherein the inner surface of the tubular portion is formed with a plurality of axially extending ribs and a plurality of radially inwardly directed ledges, the ribs and the ledges being formed to engage a peripheral shoulder of the neck in order to attach the base securely to the neck, a lid of flexible material pivotally supported on the base by a post depending from an underside of the lid, the post being received in a slot at the periphery of the base adjacent to the rim, the post being formed to bias the lid into engagement with the rim to close the opening and wherein the lid has an extension projecting beyond the periphery of the base adjacent to the post that is adapted to be depressed to pivot the lid to uncover the base opening, the rim being curved between a peripheral region of the rim adjacent the slot and an oppositely located peripheral region of the rim about a horizontal axis located below said rim with a first radius of curvature and the lid being similarly curved and having a second radius of curvature that is slightly smaller than the first radius of curvature such that upon the lid being biased into engagement with the rim, the lid uniformly engages the rim to ensure closure of the base opening.

20. The closure of claim 19, wherein the base and the lid are formed as a contiguous one-piece structure of resilient material, the base and the lid each having an extension at which the base and the lid are attached, the base extension being formed as a curved resilient spring member that constitutes said biasing means for biasing the lid into engagement with the rim.

21. The closure of claim 19, wherein the base further includes an inner substantially conically shaped tear-away seal for sealing the neck opening, the seal having a pull ring attached thereto adapted to be grasped by a user for removing the seal.

22. The closure of claim 19, wherein the base is shaped to provide a pouring spout to facilitate dispensing of a liquid within the bottle.

* * * * *